US005411267A

United States Patent [19]

Burks et al.

[11] Patent Number: 5,411,267

[45] Date of Patent: May 2, 1995

[54] GOLF BALL TEEING APPARATUS

[76] Inventors: Donald Burks, 10624 Santa Cruz Ave.; Walter Flynn, 8490 Warwick, both of Desert Hot Springs, Calif. 92240

[21] Appl. No.: 101,969

[22] Filed: Aug. 4, 1993

[51] Int. Cl.[6] ..... A63B 57/00

[52] U.S. Cl. ..... 273/201

[58] Field of Search ..... 273/32.5, 195, 201

[56] References Cited

U.S. PATENT DOCUMENTS

| | | | |
|---|---|---|---|
| 2,450,206 | 9/1948 | Shouse | 273/201 |
| 2,789,824 | 4/1957 | Willcox | 273/201 |
| 3,294,402 | 12/1966 | Scott | 273/201 |
| 3,519,275 | 7/1970 | Meierjohan | 273/201 |
| 4,441,717 | 4/1984 | Willcox | 273/201 |
| 4,957,296 | 9/1990 | Turnidge et al. | 273/201 |
| 4,995,614 | 2/1991 | Tange | 273/201 |

*Primary Examiner*—Raleigh W. Chiu
*Attorney, Agent, or Firm*—J. E. Brunton

[57] ABSTRACT

An automatic golf ball teeing apparatus for use either indoors or outdoors which can be installed above ground and requires no electricity, propellant or other remote power source for operation. The apparatus is capable of storing and sequentially dispensing by gravity a large number of golf balls to a tee unit of adjustable height. A unique pneumatic air cylinder arrangement functions as a timer for regulating the operation of a linkage system that sequentially delivers the balls from the storage unit to the tee unit.

19 Claims, 3 Drawing Sheets

GOLF BALL TEEING APPARATUS

BACKGROUND OF THE INVENTION

1. Field of the Invention

The present invention relates generally to apparatus for facilitating the practice of the game of golf. More particularly, the apparatus concerns an improved, self-contained, automatic golf ball teeing device for installation above ground for both indoor and outdoor practicing.

2. Discussion of the Invention

Several types of golf ball teeing devices have been suggested in the past. More frequently than not, these devices tend to be of complex construction and are intended for permanent installation on a golf driving range or the like. Typically, the prior art devices include a ball supply unit connected with an automatic teeing unit. Generally, the teeing mechanism is mounted below ground level and functions to deliver one ball at a time from the supply unit to an upraised tee. Frequently a foot pedal is used to trigger the transfer of the golf ball from the supply unit to the tee. The apparatus illustrated and described in U. S. Pat. No. 2,711,321 issued to J.W. McGraw, Sr. is exemplary of a typical prior art golf ball teeing apparatus.

Another golf ball teeing device is illustrated and described in U.S. Pat. No. 2,127,282 issued to Clay C. Beckett. This device, like the McGraw device, is adapted to be buried in the ground at a teeing position. The device includes a golf ball reservoir adapted for cooperation with means for delivering balls from the reservoir to the tee in sequential fashion. The reservoir comprises a vertically extending, substantially cylindrically shaped casing which includes a helical runway along which the golf balls can travel as they advance toward the tee.

As a general rule, the prior art golf ball teeing devices are difficult to install and, because they are primarily adapted for below-surface installation, are difficult to maintain. Further many of the devices are of a rather crude design which makes them somewhat difficult to operate and generally unsatisfactory for continued use in a typical golf ball driving range environment.

The thrust of the present invention is to provide a highly reliable, easy-to-operate golf ball teeing apparatus which includes an automatic golf ball dispenser unit capable of storing and dispensing on the order of 125 golf balls. The apparatus of the invention is designed to be manufactured as a self-contained unit which can be easily installed above ground at any desired location on a typical golf ball driving range. Because of the simplicity and compactness of the design, if desired, the apparatus can also conveniently be used at indoor locations. Advantageously, the dispenser unit is designed to provide a safety barrier wall between adjacent units to protect the user from being struck by errantly hit balls.

As will be better understood from the description that follows, the apparatus of the invention uniquely requires no electricity propellant or other remote power source for operation. The kinetic energy which operates the device is provided solely by the operator by means of a foot operated combination actuating and timing mechanism. The design of the unit is not only simple, but durable and highly reliable in use. The internal mechanisms of the apparatus primarily comprise a system of pivotally interconnected levers which function to sequentially deliver the golf balls from the storage reservoir to the adjustable tee at precisely timed intervals. The golf balls contained within the reservoir of the ball dispensing unit are easily visible to the operator and are automatically positioned on the tee, the height of which can be precisely adjusted by the operator using a control knob which is interconnected with the system of levers.

SUMMARY OF THE INVENTION

It is an object of the present invention to provide a simple, easy-to-use and easy-to-maintain golf ball teeing apparatus which can expeditiously be set up and used either indoors or outdoors. The apparatus is specifically designed to be installed above ground and requires no electricity, propellant or other remote power source for operation.

Another object of the invention is to provide an automatic golf ball dispensing unit which is capable of storing and dispensing a large number of golf balls that are gravity fed from the dispenser to a tee of adjustable height.

Another object of the invention is to provide a golf ball teeing apparatus of the aforementioned character in which the golf balls contained within the dispensing unit are readily visible to the user.

Another object of the invention is to provide an apparatus of the character described in the preceding paragraphs in which the operating mechanism is of a simple, straight-forward and relatively maintenance-free construction primarily consisting of a foot actuated system of fulcrums and levers.

Another object of the invention is to provide a golf ball teeing apparatus which includes a novel means for automatically timing the delivery of the golf balls from the dispenser unit to the adjustable tee. More particularly, the apparatus embodies a unique, pneumatic air cylinder arrangement which functions as the timing means for sequentially delivering one ball at a time from the dispensing unit to the teeing unit at a controlled time interval.

Yet another object of the invention is to provide a golf ball teeing apparatus which includes an upstanding ball dispensing unit which functions as a safety barrier between the operator and adjacent practice apparatus.

Another object of the invention is to provide a golf ball teeing apparatus of the class described which is attractive, easy to install, and generally inexpensive to manufacture and maintain.

DESCRIPTION OF THE INVENTION

Figure 1:
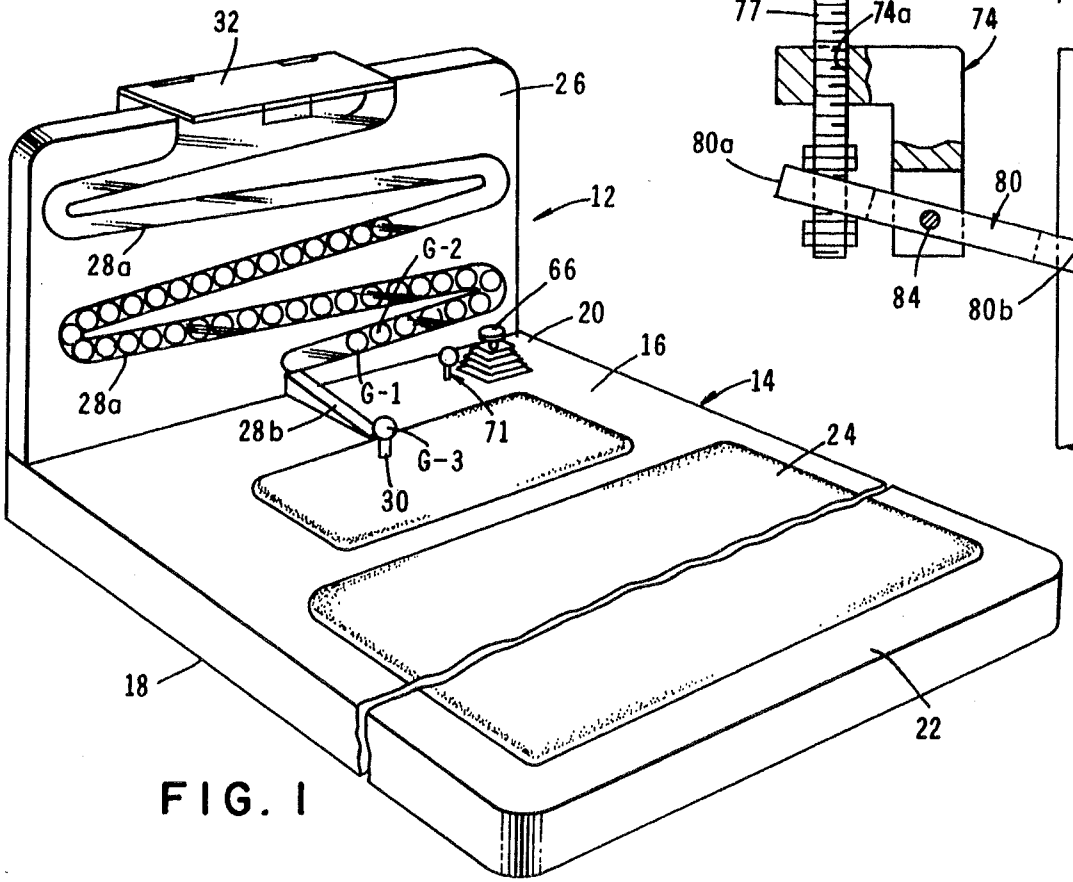
FIG. 1 is a generally perspective view of one form of the golf ball teeing apparatus of the present invention.
Figure 2:
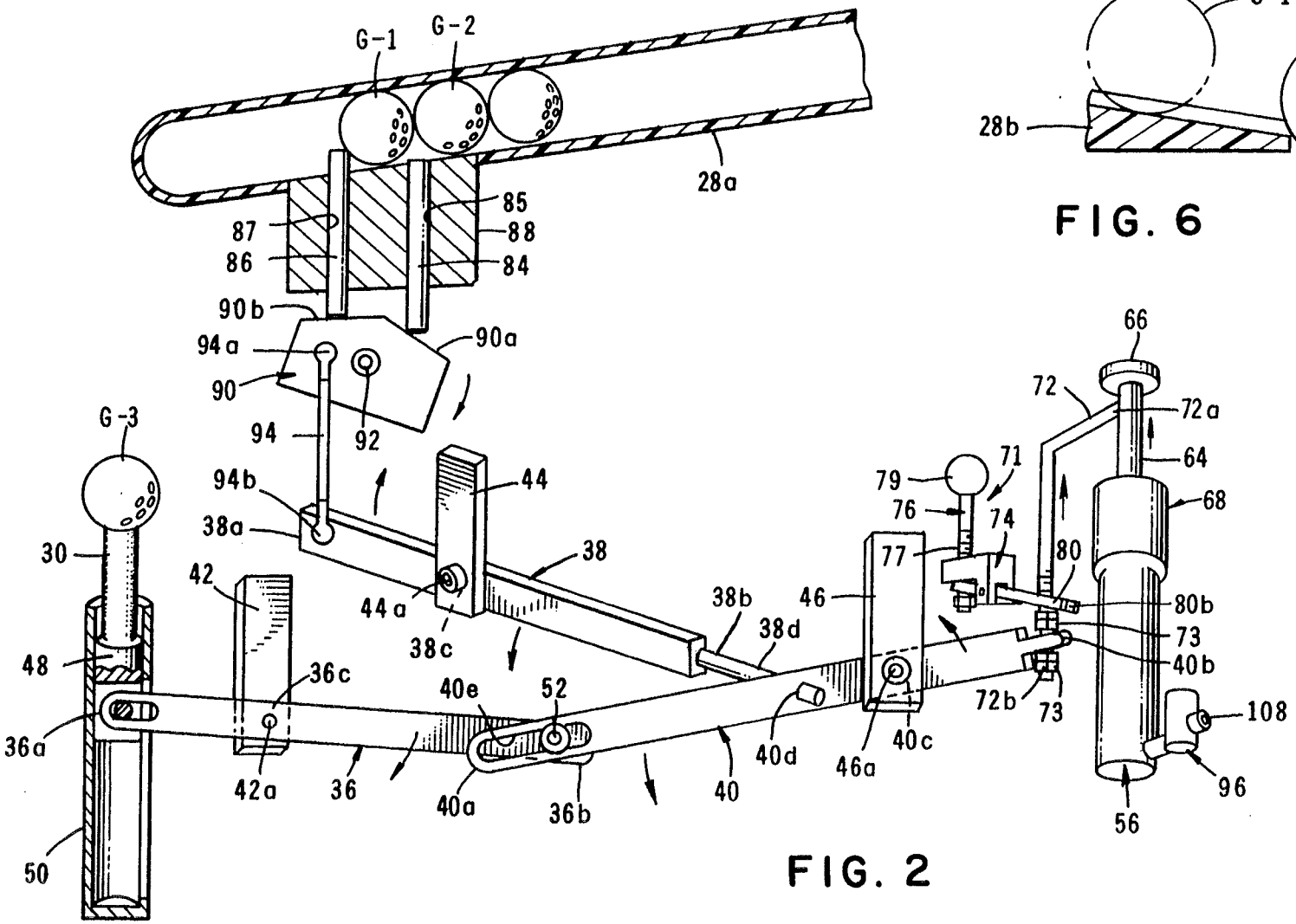
FIG. 2 is a generally diagrammatic view of the operating mechanism of the apparatus illustrating the manner in which the various operating levers of the apparatus are operably interconnected.

Referring to the drawings and particularly to FIGS. 1 and 2, one form of the golf ball teeing apparatus of the invention is there illustrated and generally designated by the numeral 12. As indicated in FIG. 1, the apparatus comprises a base 14 having an interior chamber disposed between an upper wall 16 and a lower base wall 18. Upper wall 16 defines an upper surface having a first marginal portion 20 (see FIG. 1), a second marginal portion 22, and a standing portion 24.

Provided proximate first marginal portion 20 is a golf ball containment means which is connected to base 14 for containing a multiplicity of golf balls. The containment means here comprises an upstanding body portion 26 within which is formed the first portion 28*a* of an inclined ramp along which the golf balls roll by force of gravity. A second ramp portion 28*b* connects with ramp portion 28*a* and extends generally perpendicularly from the golf ball containment means toward a golf ball support means that includes a tee 30, which in a manner presently to be described, is movable between a first lowered position and a second elevated position wherein the top of the tee extends above the upper surface of top wall 16. With this construction, tee 30 is disposed intermediate the upstanding body 26 and the standing portion 24 of the apparatus. Body portion 26 of the containment means is of a sufficient height to function as a barrier means for intercepting the flight of errant golf balls from adjacent an apparatus or from golf balls flying from tee 30 in a direction toward the barrier means.

Upstanding body 26 is provided proximate its upper portion with a cover 32 which can be lifted to gain access to ramp portion 28*a* so that golf balls can be conveniently added to the body portion as may be necessary. Ramp portions 28*a* and 28*b* are gently inclined so that the golf balls can roll downwardly of ramp 28*a* and 28*b* in the manner illustrated in FIG. 1. So that the number of golf balls contained within the upstanding body can be viewed at any time by the trainee, a sheet of transparent material such as polycarbonate is placed over ramp portion 28*a*.

Figures 3, 5:
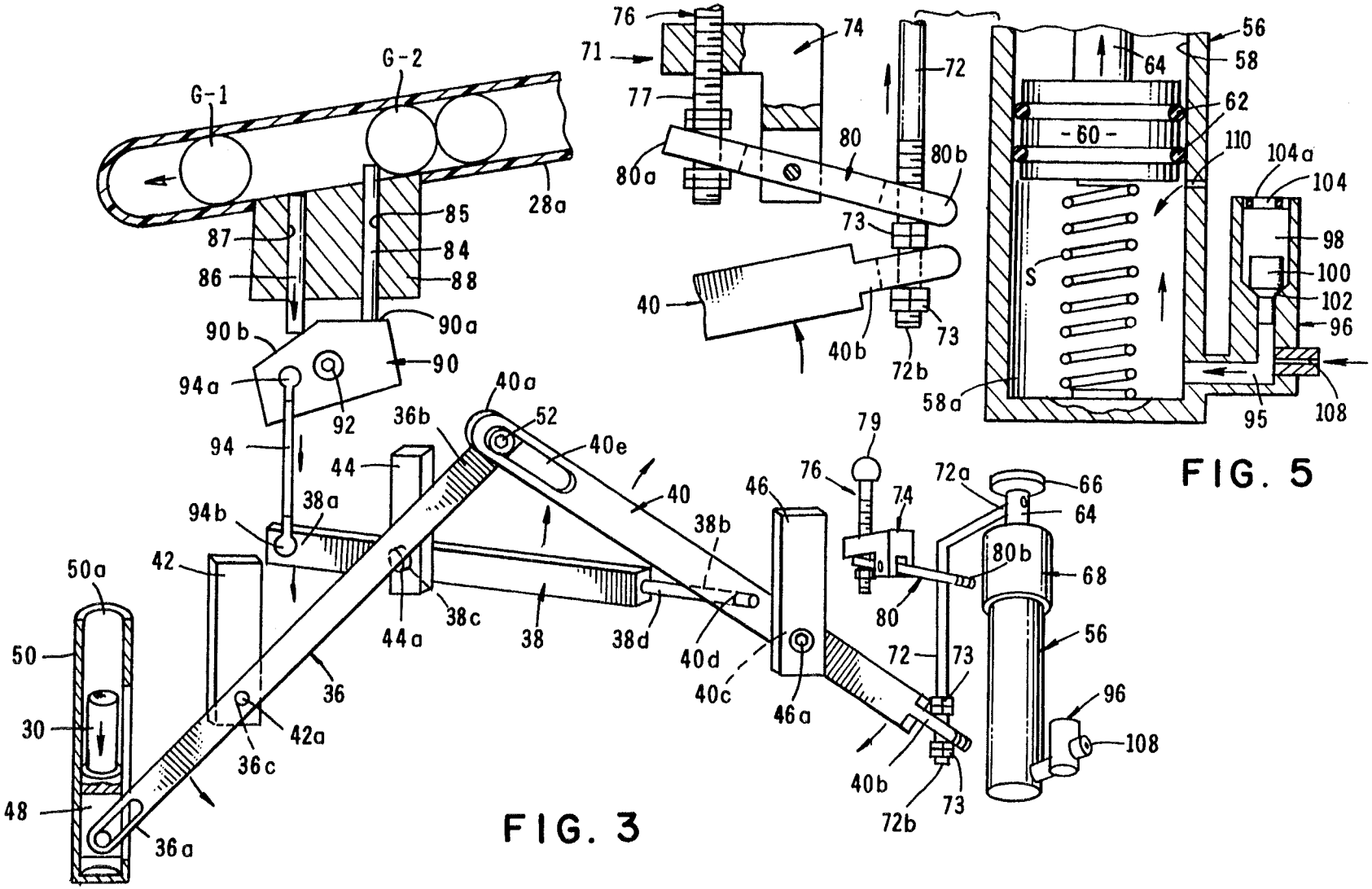
FIG. 3 is a generally schematic view similar to FIG. 2 but illustrating the position of the operating mechanism of the device after the ball dispensing mechanism has been actuated by the foot of the operator.
FIG. 5 is a fragmentary, cross-sectional view similar to FIG. 4 but illustrating the position of the component parts of the actuating mechanism following actuation thereof by the operator.

Turning now to FIGS. 2 and 3, the operating means of the present invention for operating a metering means the character of which will presently be described, and for moving tee 30 from a lowered position to an upstanding position comprises a link means or link system which includes first, second and third pivotally interconnected links 36, 38 and 40 respectively. The link system is disposed within the interior chamber formed between upper and lower base walls 16 and 18 and is interconnected at one end with the golf ball support means and at the other end with a foot operated means. First link 36 of the link system includes a first end portion 36*a*, a second end portion 36*b*, and an intermediate connecting point 36*c*. Link 38 also includes first and second ends 38*a* and 38*b* respectively and an intermediate connecting point 38*c*. Similarly, third link 40 includes first and second end portions 40*a* and 40*b* and an intermediate connecting point 40*c*.

A first support means, or support block 42 is connected to base 14 and functions to pivotally support first link 36. More particularly, first link 36 is interconnected with block 42 by means of a pivot pin 42*a* which is located proximate connecting point 36*c* of link 36. In similar fashion, a second support means, or support block 44, is connected to base 14 and pivotally supports second link 38. Block 44 and link 38 are interconnected by a pivot pin 44*a* which is located proximate connecting point 38*c* of link 38. A third support means, or support block 46 is connected to base 14 and functions to pivotally support third link 40 by means of a pivot pin 46*a* which is located proximate connecting point 40*c* of third link 40.

As indicated in FIG. 2, first link 36 is connected proximate its slotted first end to a reciprocating means or plunger 48 which comprises a part of the golf ball support means of the invention. Plunger 48 is reciprocally movable within a housing 50 that is disposed within the interior chamber of base 14. Tee 30 is connected to plunger 48 and moves with the plunger as the plunger reciprocates upwardly and downwardly within the interior chamber of housing 50. When plunger 48 is in its upper most position as shown in FIG. 2, tee 30 is elevated above the upper surface of base wall 16. Conversely, when plunger 48 is in its lower most position, tee 30 is in its first lowered position and is completely contained within body 50.

Second end 36*b* of first link 36 is pivotally interconnected to third link 40 proximate its first end 40*a* by means of a pivot pin 52 which slides within a slot 40*c* formed in its first end. Similarly, second end 38*b* of second link 38, which terminates in an outwardly extending rod portion 38*d*, is interconnected with third link 40 via an aperture 40*d* which is formed in link 40 at a second connecting point. As indicated in the drawings, aperture 40*d* is of a diameter to closely receive the free end portion of rod portion 38*d* so that movement will be imparted to link 38 upon movement of link 40 (see FIG. 3).

Figure 4:
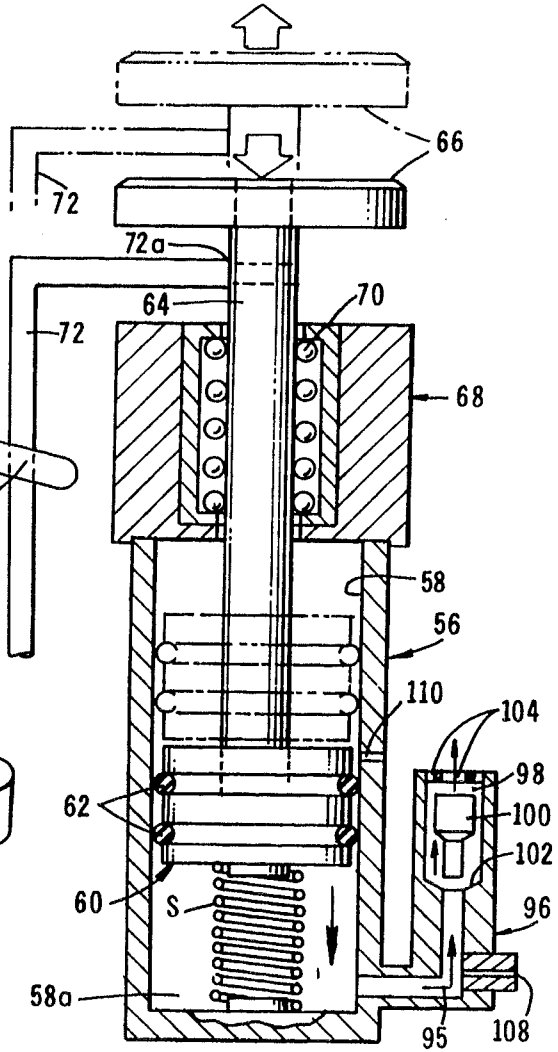
FIG. 4 is a greatly enlarged, side-elevational, cross-sectional view of the lever actuating portion of the apparatus and the tee height adjusting portion of the apparatus which is connected thereto.
Figure 4:
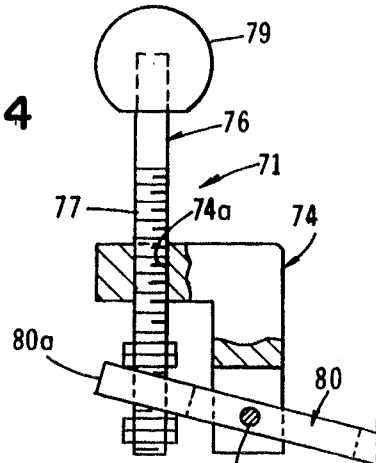

Also comprising a part of the operating means of the invention is the previously mentioned foot operated means which is connected to third link 40 proximate the second 40*b* thereof. The foot operated means of the present form of the invention functions to impart movement to links 36, 38 and 40 and includes a cylinder 56 which is housed within the interior chamber of base 14. Turning also to FIG. 4, it can be seen that cylinder 56 includes an interior chamber 58 within which a plunger 60 sealably reciprocates between a first lowered position and a second elevated position. Plunger 60 is provided with a pair of resiliently deformable O rings 62 which sealably engage the inner wall of chamber 58 as the plunger reciprocates between its first and second positions.

Provided at the lower portion 58*a* of chamber 58 is a vent means for venting air contained within chamber 58*a* to atmosphere in a manner presently to be described. A connecting rod 64 is connected at its lower end to plunger 60 and is provided at its upper end with a disk shaped foot engaging pedal 66. As indicated in FIG. 4, rod 64 extends upwardly through a bearing cap assembly 68 which is provided at the top of cylinder 56. Bearing cap assembly 68 includes a bearing race 70 which smoothly guides the travel of rod 64 upwardly and downwardly relative to the bearing cap.

As shown in FIG. 1, the foot operated means, including foot pedal 66, is safely located in close proximate with body portion 26 of the golf ball containment means and is positioned to the rear and to the right of tee 30 as viewed in FIG. 1. With the foot operating means being located at this position, it is safely out of the way so that the user of the apparatus will not accidentally trip over the upstanding foot engaging pedal 66.

Located closely adjacent to the foot operated means of the invention is tee height adjusting means generally designated in FIG. 1 by the numeral 71. This important feature of the invention, the details of which will next be described, conveniently adjusts the extent to which the golf ball receiving tee 30 protrudes above base wall 16 when the tee is in its second elevated position shown in FIGS. 1 and 2.

As best seen in FIG. 4, the tee height adjusting means of the present embodiment of the invention comprises an "L" shaped connector rod 72 having a first upper end 72*a* connected to rod 64 of the foot operated means and a second lower end 72*b* connected to apertured second end 40*b* of the third link 40 by means of adjustable nuts 73 which are threadably connected to rod 72 (FIG. 2). Connected to adjusting rod 72 intermediate its downwardly extending leg is manually operable means which is mounted on base 14 and functions to controllably move adjusting rod 72 upwardly and downwardly relative to base 14. The tee height adjusting means also comprises a generally "L" shaped block 74 which is connected to base 14. Block 74 is provided with an internally threaded bore 74*a* (FIG. 4) which is adapted to threadably receive a manually adjustable screw assembly 76. Screw assembly 76 includes an elongated rod having a threaded shank portion 77 and a generally spherically shaped head portion 79. Pivotally connected to block 74 is a pivoting element 80 having a first end 80*a* connected to the lower portion of threaded shank 77 and a second end 80*b* connected to adjusting rod 72 intermediate the ends of its downwardly extending leg. With this construction, as member 76 is threaded upwardly or downwardly relative to block 74, element 80 will pivot about pivot pin 84 which pivotally interconnects element 80 with block 74 in a manner such that end portion 80*b* will urge adjustment rod and connector rod 64 upwardly and downwardly relative to cylinder 56 and upper wall 16 of base 14.

A study of FIGS. 2 and 3 shows that a downward movement of end 40*b* of link 40 will cause a downward movement of tee 30 relative to housing 50. Conversely, an upward movement of end 72*b* of rod 72 will cause an upward movement of end portion 40*b* of link 40 which translates into an upward movement of end 36*a* of link 36 and of reciprocating member 48 which carries tee 30. With this construction, it is apparent that by threading rod 76 inwardly or outwardly of L shaped bracket 74, the height of tee 30 in its second elevated position can be precisely adjusted to accommodate the requirements of the particular practicing golfer.

Figure 6:
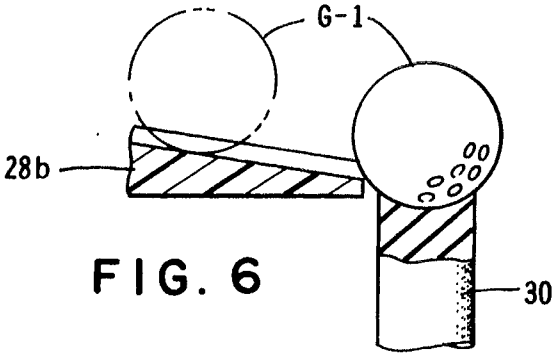
FIG. 6 is an enlarged, fragmentary view of the ramp portion of the apparatus which carries the golf balls from the reservoir to the adjustable tee by force of gravity.

Forming another important aspect of the apparatus of the present invention is metering means which is operably coupled with the containment means for sequentially permitting the golf balls contained within the containment means to roll along the inclined ramps 28*a* and 28*b* toward the terminal portion of ramp 28*b* which is disposed proximate tee 30 (FIG. 6). Referring to FIGS. 2 and 3, the metering means can be seen to here comprise first and second ball engaging regulating pins or rod-like elements 84 and 86 which reciprocate within spaced-apart, vertical bores 85 and 87 provided in a block-like member 88 which is connected to ramp portion 28*a* in the manner shown in the drawings. Also forming a part of the metering means is control means which is connected to second link 38 for moving the first and second ball engaging regulating pins 84 and 86 between the first and second positions shown in FIGS. 2 and 3. This control means is here provided in the form of a teeter block 90 which is pivotally connected to housing 26 by means of a pivot pin 92 and also includes a connecting rod or teeter link 94 having a first end 94*a* pivotally connected to block 90 and a second end 94*b* pivotally connected to second link 38 proximate end 38*a* thereof. Teeter block 90 is provided with two adjacently disposed, downwardly sloping surfaces 90*a* and 90*b*. As indicated in the drawings surface 90*a* is adapted to slidably engage the lower end of ball engaging element 84 while surface 90*b* is adapted to slidably engage the lower end of ball engaging element 86.

As shown in FIG. 2, when the apparatus of the invention is in the starting configuration, foot engaging pedal 66 is elevated above the top base wall 16 and link ends 36*b* and 40*a* are in a downward position. Similarly, pin 86 is held in its upward position against golf ball G-1 by surface 90*b* of teeter block 90. A downward force exerted on the foot operated means by the user will cause the linkages to move from the position shown in FIG. 2 to the position shown in FIG. 3. In this position, second link 38 has caused connector rod 94 to pivot teeter block 90 from the first position shown in FIG. 2 to the second position shown in FIG. 3. When the teeter block is in this position, rod 86 is permitted to move downwardly within bore 87 so that golf ball G-1 can move to the position shown in FIG. 3. As teeter block 90 moves into the position shown in FIG. 3, surface 90*a* thereof forces rod 84 upwardly into blocking engagement with golf ball G-2 in a manner to prevent it from rolling down ramp 28*a* toward golf ball G-1.

A study of FIGS. 1, 2, and 3 will also reveal that a downward movement of the foot operating means will cause link 40 to act upon link 36 in a manner to lower tee 30 into housing 50 and to simultaneously cause rod 86 to move downwardly thereby freeing golf ball G-1. When golf ball G-1 is permitted to roll down ramp 28*a* by the lowering of pin 86, ball G-1 will roll toward ramp 28*b* and then by force of gravity will roll downwardly along ramp 28*b* and onto the open top 50*a* of housing 50 (see FIG. 6). In a manner next to be described, the timing means of the invention will then function to cause the apparatus to move from the position shown in FIG. 3 to the position shown in FIG. 2 wherein the tee and the ball G-1 are raised above the top of the surface of the base placing ball G-1 in a ball striking position (see FIG. 1).

Referring again to FIG. 4, it is to be observed that as the user moves foot pedal 66 downwardly, plunger 60 will also be urged downwardly within chamber 58 against the urging of a coil spring "S". As the plunger moves downwardly, air contained within portion 58*a* of chamber 58 will be forced outwardly through a passageway 95 provided in the wall of cylindrical housing 96 of the earlier identified vent means. The vent means of this form of the invention, in addition to including housing 96 which is connected to cylinder 56 in the manner shown in FIG. 4, includes valve means for opening passageway 95 to atmosphere via a vent chamber 98 formed in a housing 96. The valve means here includes a valve member 100 which normally seats against a valve seat 102 formed within housing 98. However, air being forced under pressure from chamber 58*a* through passageway 95 and into chamber 98 will cause valve 100 to move into the open position shown in FIG. 4 thereby permitting air to vent outwardly through vent ports 104 provided in a cover 104*a* affixed to member 96.

In operating the foot operated means of the invention, as plunger 60 moves downwardly within chamber 58, it will compress spring "S" which comprises a biasing means for yieldably resisting downward movement of the plunger. When the coil spring is fully compressed so as to block further downward travel of plunger 60, the flow of air through passageway 95 will cease. As piston 60 tends to move upwardly due to the urging of the compressed spring "S", air will reenter chamber 58 through small metering jet 108 which is provided at the base of housing 96. The differential in pressure thus caused will result in valve member 100 rapidly moving into sealing engagement with seat 102. With the valve closed, the small amount of air which is permitted to flow inwardly of chamber 58*a* via jet 108 effectively retards the travel of piston 60 toward its starting position. However, when piston 60 reaches the upward position shown in FIG. 5, a second metering jet 110, which is provided near the midpoint of the outer wall of cylinder 56, will permit additional air to flow rapidly into chamber 58 thereby permitting piston 60 along with foot engaging pedal 66 and rod 64 to move upwardly more rapidly into its starting position. By regulating the size of metering jets 108 and 110, the time required for piston 60 to return to its starting position can be precisely controlled thereby controlling the time interval required for the link system to move the teeter block and regulating pins 84 and 86 from the position shown in FIG. 3 to that shown in FIG. 2.

By the time the link system reaches the starting position shown in FIG. 2, tilt block 90 will have pivoted into the position shown in FIG. 2 thereby permitting golf ball blocking element 84 to move downwardly and allowing golf ball G-2 to roll downwardly of ramp portion 28*a*. This pivotal movement of block 90 will also cause golf ball engaging element 86 to move upwardly into the position shown in FIG. 2 so as to block further travel of golf ball G-2 downwardly of ramp 28*a*.

Movement of the link system from the configuration shown in FIG. 3 into the configuration shown in FIG. 2, will also cause end 40*b* of link 40 to move upwardly which, in turn, causes link end 36*b*, to which it is pivotally connected, to move downwardly. This downward movement of link end 36*b*, in turn, causes upward movement of tee 30 into the elevated position shown in FIGS. 1 and 2 thereby lifting golf ball G-3 into a striking position. After striking the golf ball G-3, the user can, at any time cause the sequence to be repeated by merely depressing foot pedal 66 in the manner shown in FIG. 3.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A golf ball teeing apparatus comprising:

(a) a base having an upper surface and an interior chamber;

(b) a golf ball supporting means carried by said base including a gold ball receiving tee movable relative to said base between a first lower position and a second elevated position wherein said tee extends above said upper surface of said base;

(c) containment means connected to said base for containing a multiplicity of golf balls, said containment means including an inclined ramp for rollably supporting said golf balls, said ramp having a terminal portion disposed adjacent said tee;

(d) metering means connected to said containment means for sequentially permitting the golf balls contained within said containment means to roll along said inclined ramp toward said terminal portion thereof;

(e) operating means connected to said metering means and to said golf ball supporting means for operating said metering means and for moving said tee between said first and second positions, said operating means comprising first, second and third pivotally interconnected links disposed within said interior chamber of said base and foot operated means connected to said third link for imparting pivotal movement to said links, said foot operated means comprising:

(i) a cylinder disposed within said interior chamber, said cylinder having an internal chamber;

(ii) a plunger sealably receivable within said internal chamber of said cylinder for reciprocal movement therewithin between a first lowered position and a second elevated position; and (iii) a generally vertically extending connector rod having a first end connected to said plunger and a second foot engaging end extending upwardly from said upper surface of said base.

2. An apparatus as defined in claim 1 further including tee height adjusting means for manually adjusting the extent to which said golf ball receiving tee extends above said upper surface of said base when said tee is in said second elevated position, said adjusting means comprising:

(a) an adjusting rod having a first end connected to said connector rod of said foot operated means and a second end connected to said third link; and (b) manually operable means for moving said adjusting rod vertically with respect to said base thereby imparting movement to said first, second and third links.

3. An apparatus as defined in claim 1 in which said metering means comprises:

(a) first and second ball engaging elements each being movable between a first ball engaging position and a second non-ball engaging position; and (b) control means connected to said second link for moving said first and second ball engaging elements between said first and second positions.

4. An apparatus as defined in claim 1 in which said operating means further comprises:

(a) an open ended housing disposed within said interior chamber;

(b) reciprocating means reciprocally movable within said housing for supporting said golf ball receiving tee; and (c) means for connecting said reciprocating means to said first link.

5. An apparatus as defined in claim 1 in which each of said first, second and third links of said operating means includes a first end, and second end and a connecting point disposed intermediate said first and second ends, said operating means further comprising:

(a) a first support means carried by said base and connected to said first link proximate said connecting point of said first link;

(b) a second support means carried by said base and connected to said second link proximate said connection point of said second link; and (c) a third support means carried by said base and connected to said third link proximate said connection point of said third link.

6. An apparatus as defined in claim 5 in which said third link further includes a second connecting point for interconnecting said second and third links.

7. An apparatus as defined in claim 6 in which said second end of said third link is pivotally connected to said second end of said first link and in which said first end of said first link is pivotally connected to said reciprocating means of said operating means.

8. An apparatus as defined in claim 7 in which said control means of said metering means comprises a connecting rod having first and second ends said second end of said connecting rod being pivotally connected to said second end of said second link, said control means further comprising a teeter block pivotally connected to said containment means, said teeter block having a first surface adapted to engage said first ball engaging element and a second surface adapted to engage said second ball engaging element, said teeter block being pivotally connected to said first end of said connecting rod.

9. A golf ball teeing apparatus including a base having an upper surface and an interior chamber, said apparatus comprising:

(a) a golf ball supporting means carried by said base and including a tee vertically movable from a first position to a second elevated position;

(b) first link means carried by said base comprising a first link having a first end connected to said golf ball supporting means for moving said tee between said first and second positions, said first link also having a second end and a connecting point disposed intermediate said first and second ends;

(c) first support means connected to said base and to said connecting point of said first link for pivotally supporting said first link;

(d) second link means comprising a second link having a first end pivotally connected to said third link, a second end and first and second, spaced-apart intermediate connecting points;

(e) second support means connected to said base and to said first intermediate portion of said second link for pivotally supporting said second link;

(f) third link means carried by said base comprising a third link having a first end connected to said second end of said first link, said third link means also having a second end and a connecting point disposed intermediate said first and second ends;

(g) third support means connected to said base and to said point of said third link for pivotally supporting said third link;

(h) foot operated means carried by said base and connected to said third link means for imparting movement thereto, said foot operated means comprising;

(i) a cylinder having an internal chamber;

(ii) a plunger sealably receivable within said internal chamber of said cylinder for reciprocal movement therewithin between a first lowered position and a second elevated position; and (iii) a generally vertically extending connector rod having a first end connected to said plunger and a second foot engaging end extending upwardly from said upper surface of said base;

(i) containment means carried by said base for containing a multiplicity of golf balls, said containment means including an inclined ramp for rollably supporting said golf balls, said ramp having a terminal portion disposed adjacent said tee; and (j) metering means connected to said containment means for sequentially permitting the golf balls contained with said containment means to roll along said inclined ramp toward said terminal portion thereof, said metering means comprising:

(i) first and second ball engaging elements, each being movable between a first ball engaging position and a second non-ball engaging position; and (ii) control means connected to said second link means for moving said first and second ball engaging elements between said first and second positions.

10. An apparatus as defined in claim 9 in which said foot operated means further includes timer means for controlling the rate of travel of said plunger toward said second elevated position, said timer means comprising:

(a) biasing means for resisting movement of said plunger toward said first lowered position;

(b) vent means for venting air contained within said internal chamber of said cylinder to atmosphere; and (c) means for controlling the flow of air from atmosphere into said internal chamber.

11. An apparatus as defined in claim 9 in which said golf ball supporting means further comprises:

(a) an open ended housing disposed within said interior chamber of said base;

(b) a reciprocating means reciprocally movable within said housing for supporting said tee; and (c) means for connecting said reciprocating means to said first end of said first link.

12. An apparatus as defined in claim 9 in which said base includes a first marginal portion disposed on one side of said tee and a standing portion disposed on the opposite side of said tee, said containment means being disposed proximate said first marginal portion and comprising an upstanding barrier means for blocking the flight of erratic golf balls in a direction toward said containment means.

13. A golf ball teeing apparatus comprising:

(a) a base having an interior chamber, a first marginal upper surface portion and a standing portion;

(b) a golf ball supporting means carried by said base including a tee disposed intermediate said first marginal portion and said standing portion, said tee being movable relative to said base between a first lower position and a second elevated position wherein said tee extends above said first marginal upper surface portion of said base;

(c) containment means connected to said base for containing a multiplicity of golf balls, said containment means comprising:

(i) an upstanding body disposed proximate said first marginal portion of said base; and (ii) an inclined ramp for rollably supporting said golf balls, said ramp having a terminal portion disposed adjacent said tee;

(d) metering means connected to said containment means for sequentially permitting the golf balls contained with said containment means to roll along said inclined ramp toward said terminal portion thereof;

(e) first link means carried by said base comprising a first link having a first end connected to said golf ball supporting means for moving said tee between said first and second positions, said first link also having a second end and a connecting point disposed intermediate said first and second ends;

(f) first support means connected to said base and to said connecting point of said first link for pivotally supporting said first link;

(g) second link means comprising a second link having a first end pivotally connected to said third link, a second end and first and second, spaced-apart intermediate connecting points;

(h) second support means connected to said base and to said first intermediate portion of said second link for pivotally supporting said second link;

(i) third link means carried by said base comprising a third link having a first end connected to said second end of said first link, said third link means also having a second end and a connecting point disposed intermediate said first and second ends;

(j) third support means connected to said base and to said point of said third link for pivotally supporting said third link;

(k) foot operated means carried by said base and connected to said third link means for imparting movement to said third link means, said foot operated means comprising;

(i) a cylinder having an internal chamber;

(ii) a plunger sealably receivable within said internal chamber of said cylinder for reciprocal movement therewithin between a first lowered position and a second elevated position; and (iii) a generally vertically extending connector rod having a first end connected to said plunger and a second foot engaging end extending upwardly from said first marginal upper surface portion of said base.

14. An apparatus as defined in claim 13 in which said metering means comprises:

(a) first and second ball engaging elements each being movable between a first ball engaging position and a second non-ball engaging position; and (b) control means connected to said second link means for moving said first and second ball engaging elements between said first and second positions.

15. An apparatus as defined in claim 14 in which said foot operated means further includes timer means for controlling the rate of travel of said plunger toward said second elevated position, said timer means comprising:

(a) an adjusting rod having a first end connected to said connector rod of said foot operated means and a second end connected to said third link; and (b) manually operable means for moving said adjusting rod vertically with respect to said base thereby imparting movement to said first, second and third links.

16. An apparatus as defined in claim 15 in which said golf ball supporting means further comprises:

(a) an open ended housing disposed within said interior chamber;

(b) a reciprocating means reciprocally movable within said housing for supporting said tee; and (c) means for connecting said reciprocating means to said first end of said first link.

17. An apparatus as defined in claim 16 in which said inclined ramp of said containment means comprises a first portion disposed within said upstanding body and a second portion disposed between said upstanding body and said tee.

18. An apparatus as defined in claim 17 in which said first portion of said inclined ramp is covered by a transparent sheet of material.

19. An apparatus as defined in claim 17 in which said tee height adjusting means and said foot operating means are disposed proximate said upstanding body of said containment means.

* * * * *